US008028991B2

(12) United States Patent
Hirokawa et al.

(10) Patent No.: US 8,028,991 B2
(45) Date of Patent: Oct. 4, 2011

(54) IMAGE FORMING APPARATUS

(75) Inventors: Ryosuke Hirokawa, Kanagawa (JP); Hiroyuki Watase, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 469 days.

(21) Appl. No.: 12/003,132

(22) Filed: Dec. 20, 2007

(65) Prior Publication Data

US 2008/0150227 A1 Jun. 26, 2008

(30) Foreign Application Priority Data

Dec. 21, 2006 (JP) ..... 2006-344510

(51) Int. Cl.
*B65H 5/02* (2006.01)

(52) U.S. Cl. ..... 271/273; 271/272

(58) Field of Classification Search ..... 271/219, 271/272, 273; 384/24, 142
See application file for complete search history.

(56) References Cited

U.S. PATENT DOCUMENTS

| | | | | |
|---|---|---|---|---|
| 3,334,892 | A * | 8/1967 | Janecek et al. | 271/314 |
| 4,077,680 | A * | 3/1978 | Ashauer et al. | 384/218 |
| 4,411,419 | A * | 10/1983 | Silverman et al. | 271/263 |
| 4,977,828 | A * | 12/1990 | Douglas | 101/142 |
| 5,015,104 | A * | 5/1991 | Sato | 384/296 |
| 5,205,551 | A * | 4/1993 | Nagano et al. | 271/225 |
| 5,542,685 | A * | 8/1996 | Allen et al. | 279/2.02 |
| 5,662,177 | A * | 9/1997 | Bosma | 173/202 |
| 5,688,219 | A * | 11/1997 | Renard et al. | 493/357 |
| 5,775,686 | A * | 7/1998 | Miyake | 271/127 |
| 5,990,426 | A * | 11/1999 | Amonett | 200/38 R |
| 6,206,368 | B1 * | 3/2001 | Kobayashi et al. | 271/273 |
| 6,367,734 | B1 * | 4/2002 | Cartwright | 242/599.1 |
| 6,453,135 | B1 | 9/2002 | Saemshima et al. | |
| 6,616,136 | B1 * | 9/2003 | Huang et al. | 271/10.13 |
| 6,619,649 | B2 * | 9/2003 | Takamatsu | 271/3.14 |
| 6,702,227 | B1 * | 3/2004 | Newman et al. | 242/598.6 |
| 6,848,685 | B2 * | 2/2005 | Katsuyama | 271/162 |
| 7,497,434 | B2 * | 3/2009 | Park | 271/127 |
| 2002/0063374 | A1 * | 5/2002 | Takahashi | 271/10.01 |
| 2002/0089271 | A1 * | 7/2002 | Turner | 312/321.5 |
| 2004/0004154 | A1 * | 1/2004 | Sommerfeld et al. | 242/599.4 |
| 2004/0256787 | A1 * | 12/2004 | Wada et al. | 271/109 |
| 2005/0017430 | A1 * | 1/2005 | Takahashi et al. | 271/10.01 |
| 2005/0140083 | A1 * | 6/2005 | Koga et al. | 271/121 |
| 2006/0280533 | A1 * | 12/2006 | Ozawa | 399/361 |
| 2007/0052164 | A1 | 3/2007 | Watase et al. | |
| 2007/0057444 | A1 * | 3/2007 | Sagawa et al. | 271/225 |
| 2007/0057448 | A1 * | 3/2007 | Hiura | 271/273 |

(Continued)

FOREIGN PATENT DOCUMENTS

JP SHO 62-032198 8/1987

(Continued)

*Primary Examiner* — Stefanos Karmis
*Assistant Examiner* — Howard Sanders
(74) *Attorney, Agent, or Firm* — Harness, Dickey & Pierce, PLC

(57) ABSTRACT

A supporting unit is mounted on a body of an image forming apparatus in a swingable manner around a swing fulcrum. A through shaft serves as the swing fulcrum, which is inserted into the supporting unit through the swing fulcrum so that both ends of the through shaft are supported by supporting members. The through shaft includes at least one of an operation member that is slidable on the through shaft in an axial direction and a biasing unit that biases a sliding force in one direction of the axial direction. When the supporting unit is opened with respect to the body, at least a part of a conveying path on which the recording medium is conveyed is exposed.

16 Claims, 10 Drawing Sheets

U.S. PATENT DOCUMENTS

| | | | | |
|---|---|---|---|---|
| 2007/0216243 | A1* | 9/2007 | Agematsu | 310/90 |
| 2007/0246879 | A1* | 10/2007 | Sagawa et al. | 271/12 |

FOREIGN PATENT DOCUMENTS

| | | |
|---|---|---|
| JP | HEI 8-320634 | 12/1996 |
| JP | 2001-142378 | 5/2001 |
| JP | 2002-278364 | 9/2002 |
| JP | 2003-103870 | 4/2003 |
| JP | 2003-186371 | 7/2003 |
| JP | 2003-241466 | 8/2003 |
| JP | 2003-241616 | 8/2003 |
| JP | 2005-091569 | 4/2005 |
| JP | 2005-283887 | 10/2005 |
| JP | 2006-126562 | 5/2006 |

* cited by examiner

IMAGE FORMING APPARATUS

CROSS-REFERENCE TO RELATED APPLICATIONS

The present application claims priority to and incorporates by reference the entire contents of Japanese priority document 2006-344510 filed in Japan on Dec. 21, 2006.

BACKGROUND OF THE INVENTION

1. Field of the Invention

The present invention relates to an image forming apparatus that forms an image on a recording medium, such as a copier, a printer, a facsimile, and a multifunction product.

2. Description of the Related Art

In an image forming apparatus such as a copier, a printer, a facsimile, and a multifunction product (MFP), an image is formed by conveying a recording medium such as a sheet on a conveying path, so that a sheet may be jammed during a conveyance of the sheet. Because the sheet jam is basically cleared by a user, it is indispensable to make a jam processing easier for a user.

Japanese Patent Application Laid-open No. 2003-186371 discloses an image forming apparatus in which a cover unit that includes a transfer carrying belt unit, a guiding plate, and a registration roller on a driven side is arranged to be openable with respect to a body of the apparatus so that a sheet conveying path from a sheet feeding roller to a portion just before a fixing unit is exposed. The cover unit is supported by a swing shaft in a swingable manner with respect to the body. The cover unit needs to be detachable from the body for a maintenance or a component replacement.

FIG. 17 is a perspective view of a swing shaft supporting portion for supporting a detachable cover unit. An oval-shaped shaft 200 with an oval section that is short in an axial direction is arranged on each inner wall of both side plates of a body of an image forming apparatus. The cover unit includes bearing members 210 each having a cutout portion 211 from which a small diameter portion 201 of the oval-shaped shaft 200 can escape. The oval-shaped shaft 200 is inserted into the bearing member 210 by allowing the small diameter portion 201 to pass through the cutout portion 211. In this state, a large diameter portion 202 of the oval-shaped shaft 200 is supported by the bearing member 210. The configuration makes it possible for the cover unit to swing with respect to the body. In addition, by appropriately positioning the cutout portion 211 with respect to the small diameter portion 201 and moving the cover unit in a direction in which the small diameter portion 201 can escape, the cover unit can be taken out of the body.

However, when such bearing configuration is used, a positioning accuracy of the cover unit is degraded because each end of the cover unit is independently supported by the oval-shaped shaft 200, which may adversely affect a sheet conveyance or an image transfer. Specifically, a misalignment occurs in a shaft line of a conveying unit in the cover unit with respect to a conveying unit in the body that conveys sheets in cooperation with the conveying unit in the cover unit, which may cause jamming or skewing of sheets.

SUMMARY OF THE INVENTION

It is an object of the present invention to at least partially solve the problems in the conventional technology.

An apparatus for forming an image on a recording medium, according to one aspect of the present invention, includes a supporting unit that is mounted on a body of the apparatus in a swingable manner around a swing fulcrum and a through shaft that serves as the swing fulcrum, the through shaft being inserted into the supporting unit through the swing fulcrum so that both ends of the through shaft are supported by supporting members. The through shaft includes at least one of an operation member that is slidable on the through shaft in an axial direction and a biasing unit that biases a sliding force in one direction of the axial direction. When the supporting unit is opened with respect to the body, at least a part of a conveying path on which the recording medium is conveyed is exposed The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
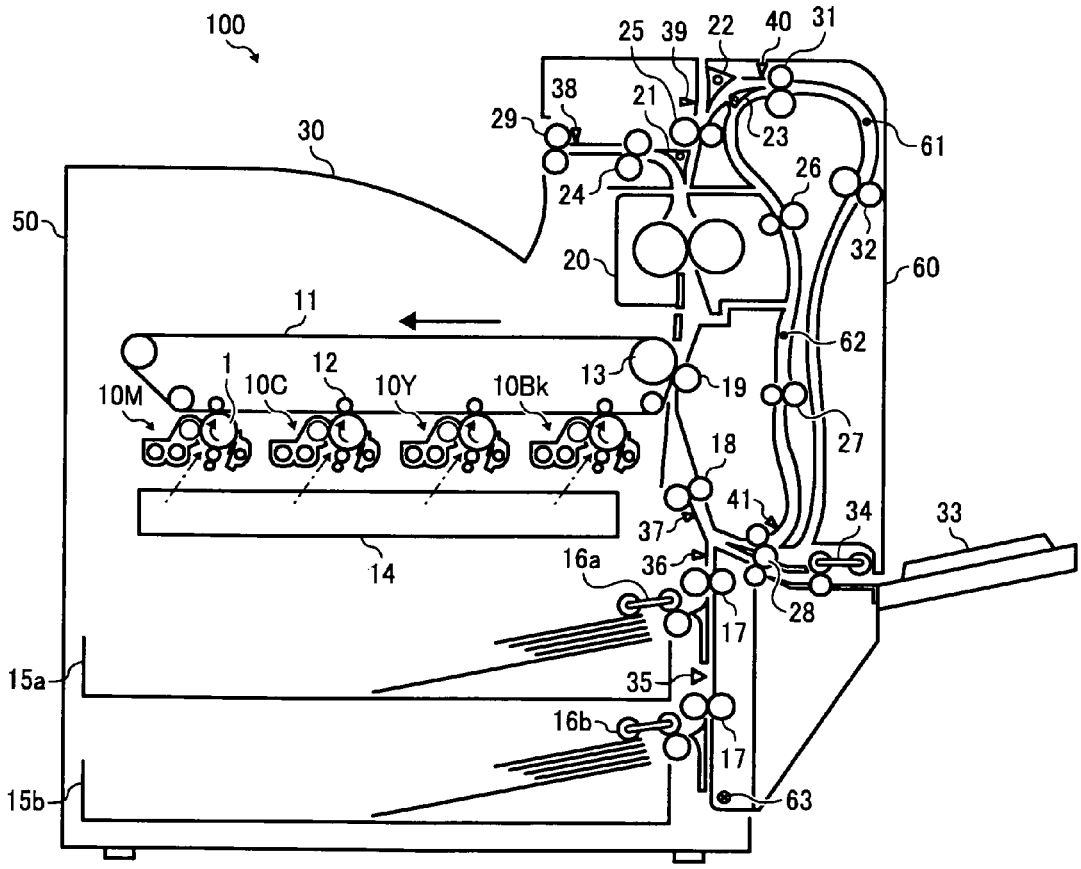
FIG. 1 is a schematic diagram of a full-color printer as an example of an image forming apparatus according to the present invention.

FIG. 1 is a schematic diagram of a full-color printer 100 such as a color laser printer as an example of an image forming apparatus according to the present invention.

As shown in FIG. 1, the printer 100 includes an intermediate transfer belt 11 and image forming units 10M, 10C, 10Y, and 10Bk for magenta, cyan, yellow, and black, respectively. The intermediate transfer belt 11 is arranged substantially in the middle of the printer 100, and is stretched over a plurality of rollers. The image forming units 10M, 10C, 10Y, and 10Bk are arranged along a lower side of the intermediate transfer belt 11.

Each of the image forming units 10M, 10C, 10Y, and 10Bk includes a photosensitive drum 1 as an image carrier, and a charging unit, a developing unit, a cleaning unit, and the like that are arranged around the photosensitive drum 1. A transfer roller 12 is arranged as a primary transfer unit inside the intermediate transfer belt 11 opposite to the photosensitive drum 1. The image forming units 10M, 10C, 10Y, and 10Bk have the same configuration using different developers for different colors. The image forming units 10M, 10C, 10Y, and 10Bk are arranged in the order of magenta, cyan, yellow, and black from the left in FIG. 1. Each of the image forming units 10M, 10C, 10Y, and 10Bk is detachably mounted on a body 50 of the printer 100 as a process cartridge.

An optical writing unit 14 is arranged below the image forming units 10M, 10C, 10Y, and 10Bk. The optical writing unit 14 that includes a polygon mirror and a mirror group (not shown) emits an optically-modulated laser beam on a surface of each of the photosensitive drums 1. A plurality of optical writing units can be respectively arranged for the image forming units 10M, 10C, 10Y, and 10Bk. However, it is advantageous in cost to use a single optical writing unit in common for the image forming units 10M, 10C, 10Y, and 10Bk. The intermediate transfer belt 11 and the optical writing unit 14 are each formed as a unit, so that each of them can be detached from the body 50.

Two stages of sheet feeding cassettes 15*a* and 15*b* for sheet feeding units 16*a* and 16*b* are installed at a lower portion of the printer 100. Each of the sheet feeding units 16*a* and 16*b* includes a pick-up roller, a feeding roller, and a separating roller. Pairs of a driving roller 17*a* and a driven roller 17*b* (conveying rollers 17) are arranged to convey a recording medium (hereinafter, "a sheet") such as a printing paper fed by the sheet feeding units 16*a* and 16*b*. A pair of registration rollers 18 is arranged above the upper pair of conveying rollers 17 (on a downstream side in a sheet conveying direction). A transfer roller 19 serving as a secondary transfer unit is arranged above the registration rollers 18 opposite to a transfer roller 13 that is one of the rollers over which the intermediate transfer belt is stretched.

Figure 2:
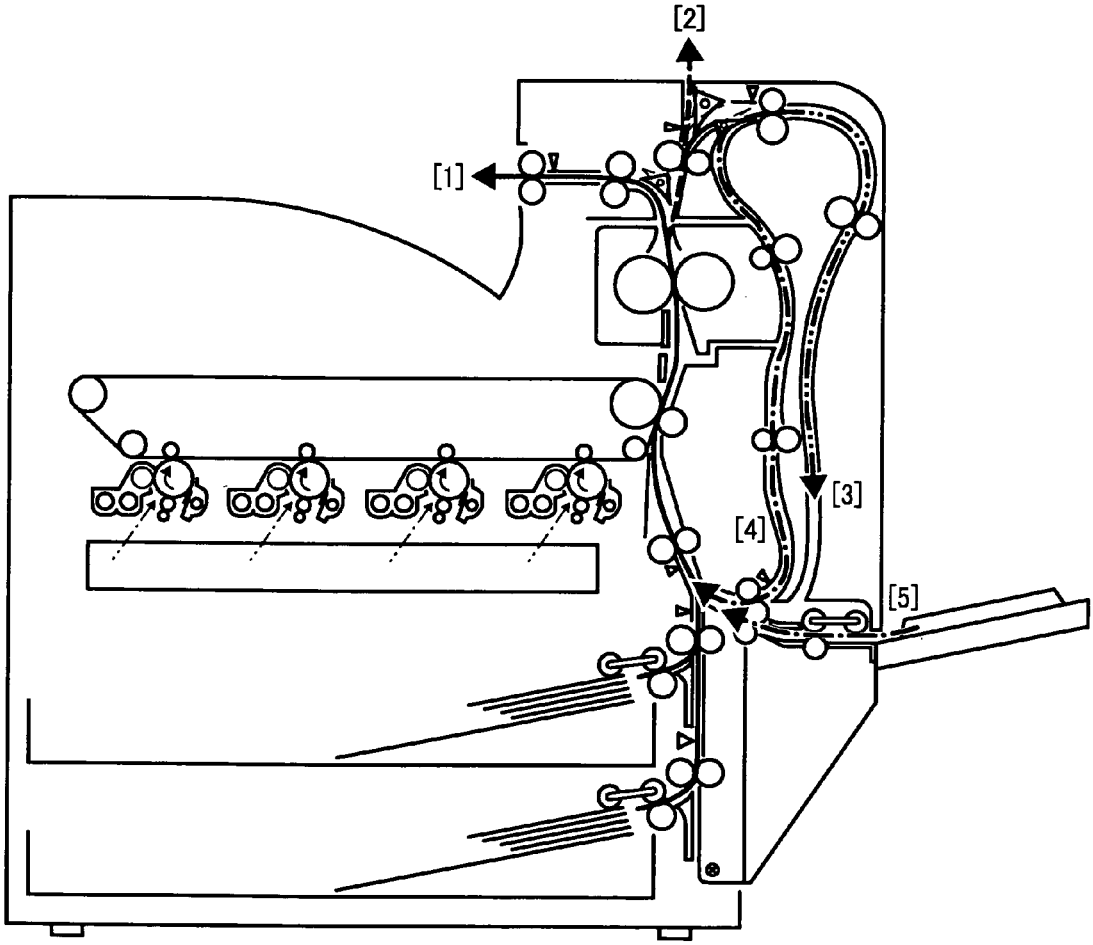
FIG. 2 is a schematic diagram for explaining sheet conveying paths of the full-color printer.

A fixing unit 20 is arranged above the secondary transfer unit, and first to third switching claws 21, 22, and 23 for switching sheet conveying directions are arranged above the fixing unit 20. Each of the switching claws 21 to 23 is switched between the positions indicated by a solid line and a broken line in FIG. 2 by a driving force of an actuator such as a solenoid (not shown). Pairs of conveying rollers 24 to 27 and sheet sensors 35 to 41 are appropriately arranged on a sheet conveying path. The sheet conveying path is appropriately formed by members such as guiding plates.

A sheet discharging tray 30 is arranged on top of the body 50, and a pair of sheet-discharging rollers 29 for discharging sheets to the sheet discharging tray 30 is arranged on the upper left of the fixing unit 20.

A sheet reversing unit 60 serving as a supporting unit is arranged on a right side of the body 50 shown in FIG. 1. The sheet reversing unit 60 includes a sheet reversing path 61 and a sheet returning path 62. A pair of first reversing rollers 31 is arranged at an inlet of the sheet reversing path 61 (at an upper portion of the apparatus), and a pair of second reversing rollers 32 is arranged in the middle of the sheer reversing path 61. The first and the second reversing rollers 31 and 32 can rotate in both clockwise and counterclockwise directions in FIG. 1. Pairs of conveying rollers 26 and 27 are arranged at positions at which the sheet returning path 62 are divided equally into three portions. The third switching claw 23 just next to the first reversing rollers 31 is positioned at an inlet to the sheet returning path 62 from the sheet reversing path 61.

A manual tray 33 is arranged on a side of the sheet reversing unit 60 so that the manual tray 33 can be pulled out and accommodated. In FIG. 1, the manual tray 33 is pulled out. A sheet feeding unit 34 including a pick-up roller, a feeding roller, and a separating roller is arranged to feed sheets from the manual tray 33. A sheet feeding roller 28 is positioned next to the sheet feeding unit 34 to be inner side of the body 50. Driven rollers come into close contact with the sheet feeding roller 28 on both up and down sides thereof. The sheet feeding roller 28 can be rotated in both clockwise and counterclockwise directions in FIG. 1. When a sheet is fed from the sheet returning path 62, the sheet feeding roller 28 is driven to rotate counterclockwise, and when a sheet is fed from the manual tray 33, the sheet feeding roller 28 is driven to rotate clockwise.

An image forming operation of the above-constituted full-color printer 100 is explained.

The photosensitive drum 1 of each of the image forming units 10M, 10C, 10Y, and 10Bk is driven to rotate clockwise by a driving unit (not shown) in FIG. 1, and the surface of the photosensitive drum 1 is uniformly charged to a predetermined polarity by the charging unit. The optical writing unit 14 irradiates the uniformly charged surface of each of the photosensitive drums 1 with a laser beam, so that an electrostatic latent image is formed on the surface. The desired full-color image information is separated into four pieces of single-color image information for magenta, cyan, yellow, and black, each of which is exposed on each of the photosensitive drums 1. A toner of each color is applied to the electrostatic latent image from each developing unit, so that a toner image of each color is developed.

The intermediate transfer belt 11 is driven counterclockwise as shown by an arrow in FIG. 1. The toner images of four colors are sequentially transferred one above the other to the intermediate transfer belt 11 from the photosensitive drums 1 through operations of the first transfer rollers 12 at the image forming units 10M, 10C, 10Y, and 10Bk. In this manner, the intermediate transfer belt 11 carries a full-color toner image on its surface.

A single-color image or a two or three-color image can be formed by using one or some of the image forming units 10M, 10C, 10Y, and 10Bk. For monochrome printing, the image forming unit 10Bk on the rightmost side of the image forming units 10M, 10C, 10Y, and 10Bk in FIG. 1 is used.

A residual toner adhered to a surface of the photosensitive drum 1 after a toner image is transferred to the intermediate transfer belt 11 is removed by the cleaning unit. Then, the surface of the photosensitive drum 1 is neutralized by a neutralizing unit to have an initial potential, whereby the photosensitive drum 1 is prepared for the next image forming.

A sheet is selectively fed from the manual tray 33 or one of the sheet feeding cassettes 15*a* and 15*b*, and sent to the secondary transfer section through the registration rollers 18 at which the timing for conveying the sheet is adjusted to synchronize with the movement of the intermediate transfer belt 11 carrying the toner image. In this example, a transfer voltage having a polarity opposite to that of the charged toners of the toner images on the surface of the intermediate transfer belt 11 is applied to the transfer roller 19, so that the toner images on the surface of the intermediate transfer belt is transferred to the sheet all at once. When the sheet on which the toner image is transferred passes through the fixing unit 20, the toner image is fused and fixed on the sheet by heat and pressure. The sheet with the toner image fixed thereon is discharged onto the sheet discharging tray 30 by the sheet-discharging rollers 29. A sheet conveying path for a single-side printing is indicated by a solid line [1] in FIG. 2 (when a sheet is fed from the sheet feeding cassettes 15*a* and 15*b*).

A sheet discharging tray (for example, a four-bin tray having a sorting function) can be optionally mounted on the top surface of the printer 100 that is above the second switching claw 22, and the sheet with the toner image fixed thereon can be discharged on the optionally-mounted sheet discharging tray. A sheet conveying path for discharging a sheet to the optionally-mounted sheet discharging tray (after passing through the fixing unit 20) is indicated by a broken line [2] in FIG. 2.

When performing a double-side printing, the sheet with the toner image fixed on one side is sent into the sheet reversing path 61 by properly switching the first to the third switching claws 21 to 23. In this case, the first and the second switching claws 21 and 22 are switched to the positions indicated by the broken lines in FIG. 2. The third switching claw 23 is switched to the position indicated by the solid line in FIG. 2. The first and the second reversing rollers 31 and 32 are rotated clockwise shown in FIG. 1. A sheet conveying path for sending the sheet into the sheet reversing path 61 (after passing through the conveying rollers 25) is indicated by a two-dot chain line [3] in FIG. 2.

When the sheet sensor 40 detects a rear end of the sheet sent into the sheet reversing path 61, the first and the second reversing rollers 31 and 32 are rotated counterclockwise in FIG. 1, so that the sheet is reversed. At this time, the third switching claw 23 is switched to the position indicated by the broken line in FIG. 2 to send the sheet into the sheet returning path 62.

The sheet returning path 62 is combined with the sheet conveying path from the manual tray 33 at its lower end, and is also combined with the sheet conveying path from the sheet feeding cassettes 15*a* and 15*b* on a left side of the sheet feeding roller 28. The sheet is conveyed through the sheet returning path 62 by the conveying rollers 26 and 27, and is further conveyed to the registration rollers 18 by the sheet feeding roller 28. A sheet conveying path that passes through the sheet returning path 62 (from the third switching claw 23 to the junction with the solid line [1]) is indicated by a one-dot chain line [4] in FIG. 2. A sheet conveying path for sending a sheet from the manual tray 33 (to a point at which the sheet finishes passing through the sheet feeding roller 28) is indicated by a one-dot chain line [5] in FIG. 2.

The sheet reversed in the sheet reversing path 61 is passed through the sheet returning path 62, whereby the sheet is turned upside down. Then, a toner image is transferred on a back side of the sheet from the intermediate transfer belt 11, and the toner image is fixed on the sheet at the fixing unit. The sheet carrying an image on each side is discharged to the sheet discharging tray 30 or the optionally-mounted tray, whereby the double-side printing is finished.

Figure 3:
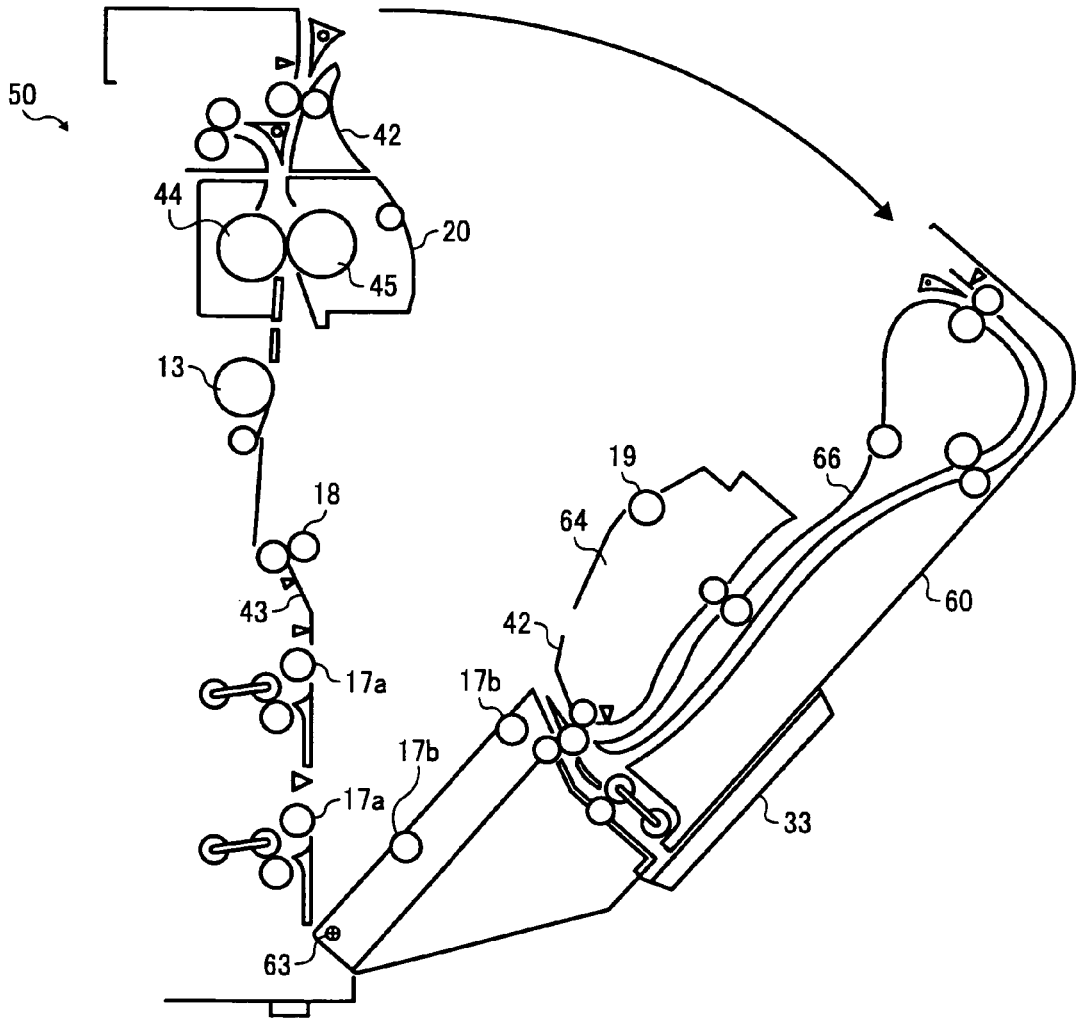
FIG. 3 is a schematic diagram for explaining a sheet reversing unit of the full-color printer in an open state.

The sheet reversing unit 60 is mounted in a swingable manner about a swing shaft 63 arranged at its lower portion as a fulcrum, and can be opened or closed with respect to the body 50. FIG. 3 is a schematic diagram of the sheet reversing unit 60 in an open state.

The sheet reversing unit 60 includes a guiding plate forming the sheet reversing path 61, part of the guiding plate 66 forming the sheet returning path 62, a transfer unit 64, the third switching claw 23, the first and the second reversing rollers 31 and 32, the manual tray 33, the sheet feeding unit 34, the sheet feeding roller 28, and the driven rollers 17*b* that are opened or closed with respect to the body 50.

Figure 17:
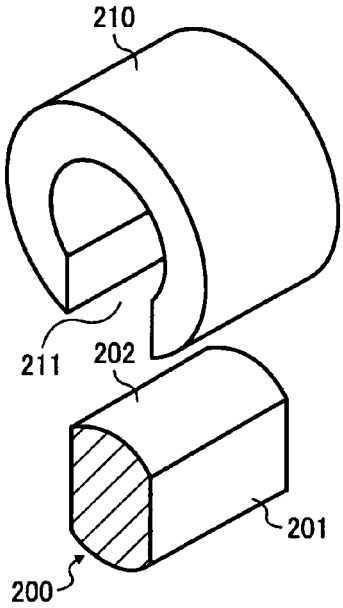
FIG. 17 is a perspective view of an example of a conventional supporting portion for a cover unit.

Thus, because the sheet reversing unit 60 can be opened, a sheet conveying path from a position just after a sheet is fed to a position just before an image on the sheet is fixed thereto is opened. Therefore, even a user can easily clear a sheet jamming. The sheet reversing unit 60 can be detached from the body 50 for maintenance or component replacement. For making the sheet reversing unit 60 detachable from the body 50, if the swing shaft 63 is composed of the bearing members 210 as shown in FIG. 17, the accuracy in positioning the cover unit and the accuracy in positioning the driven rollers 17*b* and the transfer roller 19 decrease, thereby adversely affecting a sheet conveyance or an image transfer.

Figure 4:
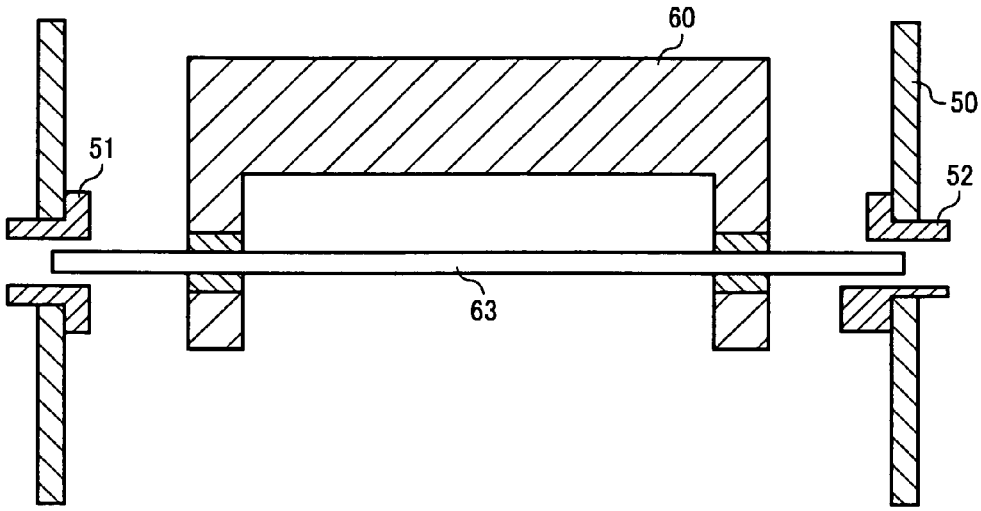
FIG. 4 is a schematic diagram of a through shaft of a sheet reversing unit according to a first embodiment of the present invention.

As shown in FIG. 4, the sheet reversing unit 60 according to the first embodiment uses the swing shaft 63 that works as a through shaft penetrating through the sheet reversing unit 60. The swing shaft 63 that works as the through shaft is formed of a hard metal, both ends of which are rotatably supported by bearings 51 and 52 mounted on the body 50. The sheet reversing unit 60 is supported by the swing shaft 63 that can move in the axial direction via a bearing unit 73.

The through shaft is used as the swing shaft 63, so that the sheet reversing unit 60 can be securely held by the through shaft, and positioned with high accuracy. Consequently, the driven rollers 17*b* and the transfer roller 19 are positioned with high accuracy, which results in preventing a sheet conveyance or an image transfer from being adversely affected. For example, because a large load is imposed on the driven rollers 17*b* when conveying a thick sheet, and a positioning accuracy of the transfer roller 19 affects a positioning accuracy of an image on the recording medium, the swing shaft 63 is used to position the sheet reversing unit 60 while the sheet reversing unit 60 securely holding the swing shaft 63, thereby significantly contributing to the thick paper conveyance or the high-quality image formation.

Although the problems in the sheet conveyance or the image transfer can be avoided by using the swing shaft 63 that works as the through shaft, the sheet reversing unit 60 needs to be detachable from the body 50 for a maintenance or a component replacement, as described above. However, when the through shaft is used as the swing shaft 63, it is difficult to pull out the swing shaft 63 from the bearings 51 and 52 and detach the sheet reversing unit 60 from the body 50.

Figure 5:
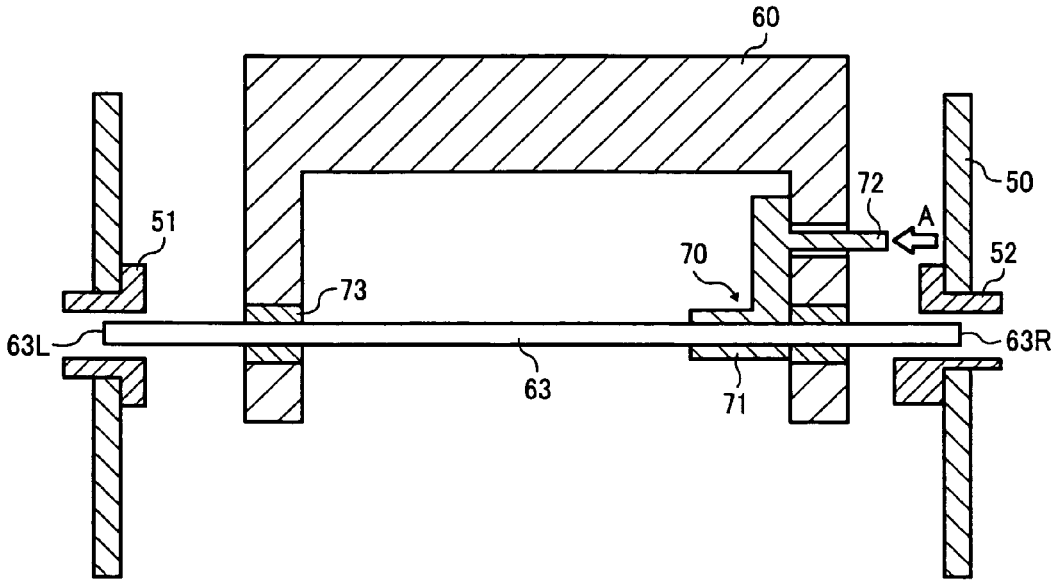
FIG. 5 is a schematic diagram of a through shaft of a sheet reversing unit according to a second embodiment of the present invention.
Figure 6:
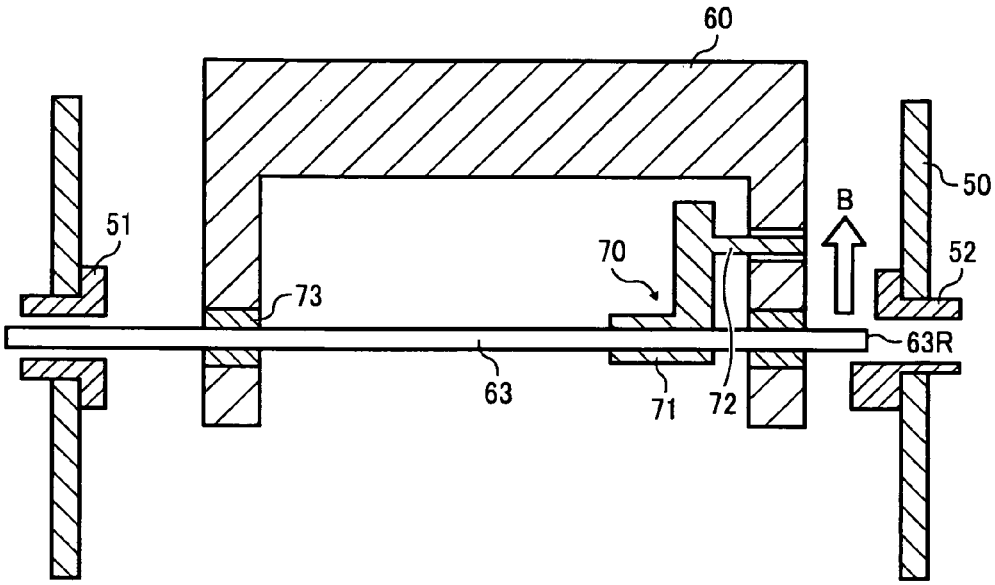
FIG. 6 is a schematic diagram for explaining an operation of taking out the through shaft shown in FIG. 5.

According to a second embodiment of the present invention, a sliding lever 70 serving as an operation member is fixed to the swing shaft 63 in FIG. 5. The sliding lever 70 includes a fixing unit 71 fixed to the swing shaft 63 and a lever unit 72 serving as an operation unit both of which are integrated. As shown in FIG. 5, when the swing shaft 63 is properly supported by the bearings 51 and 52, the tip of the lever unit 72 protrudes outside the side of the sheet reversing unit 60. When the lever unit 72 is moved to a position at which the tip aligns with the side of the sheet reversing unit 60 as shown in FIG. 6 by pushing the lever unit 72 in a direction indicated by an arrow A, a right end 63R of the swing shaft 63 is pulled out of the bearing 52.

In the image forming apparatus in which the sliding lever 70 is fixed to the swing shaft 63, the right end 63R of the swing shaft 63 is extracted from the bearing 52 simply by pushing the lever unit 72 in the direction of the arrow A, so that the sheet reversing unit 60 can be pulled out of the body 50 in a direction indicated by an arrow B. In this case, as shown in FIG. 7, a chamfered groove 52*a* is formed at an upper portion of the bearing 52 to easily pull out the sheet reversing unit 60.

The sheet reversing unit 60 using the swing shaft 63 can be pulled out of the body 50, so that it is possible to perform a maintenance of the sheet reversing unit 60, a component replacement in the sheet reversing unit 60, or the like. After performing the maintenance, the component replacement, or the like, the sheet reversing unit 60 needs to be mounted again. The operation is performed in the order opposite to the operation of pulling out the sheet reversing unit 60 from the body 50. However, it is difficult to return the swing shaft 63 from a state shown in FIG. 6 to a state shown in FIG. 5 in which the swing shaft 63 is properly supported by the bearings 51 and 52.

Figure 7:
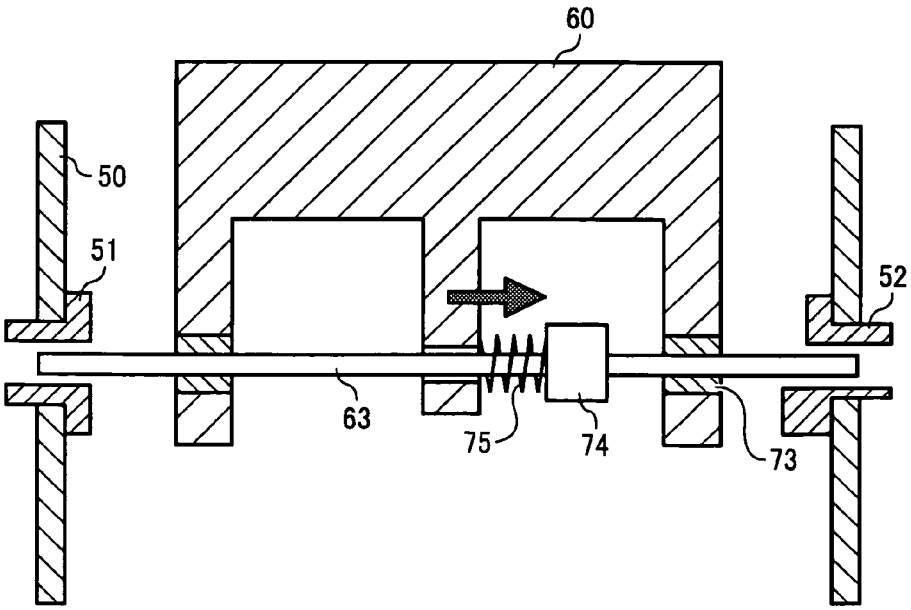
FIG. 7 is a schematic diagram of a through shaft of a sheet reversing unit according to a third embodiment of the present invention.

According to a third embodiment of the present invention, the operation of mounting the sheet reversing unit 60 is simplified by effectively utilizing a biasing of an biasing unit shown in FIG. 7.

Figure 8:
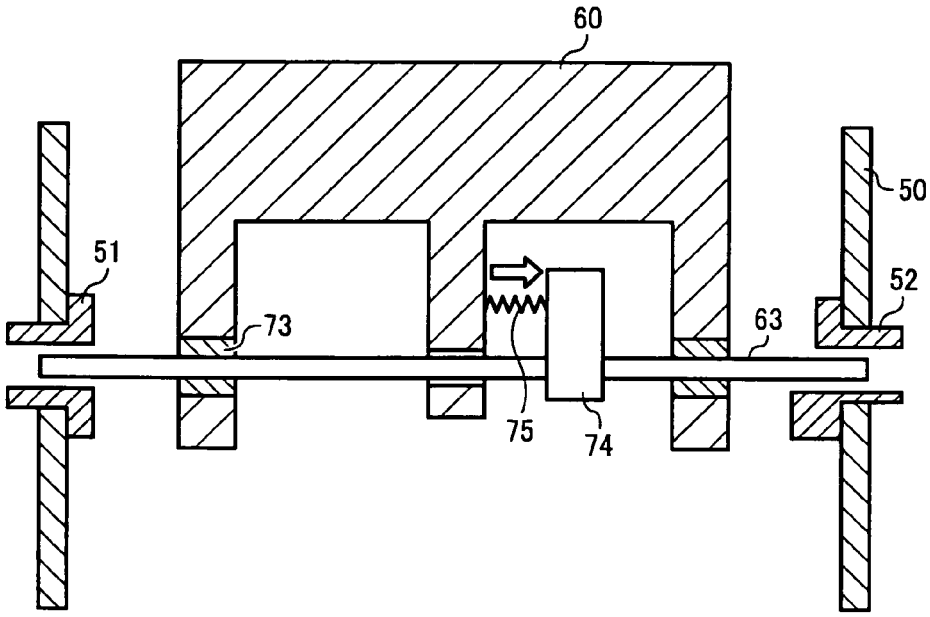
FIG. 8 is a schematic diagram of a modified example of the through shaft shown in FIG. 7.

As shown in FIG. 7, a rigid body 74 (for example, a molded component made from SECC) is fixed to the swing shaft 63, a spring 75 serving as an biasing unit is arranged between the rigid body 74 and the sheet reversing unit 60, thereby obtaining a moving force for moving the swing shaft 63 to the right in FIG. 7. The spring 75 is wound around the swing shaft 63; however, the spring 75 can be mounted between the rigid body 74 and the sheet reversing unit 60 as shown in FIG. 8.

Figure 9:
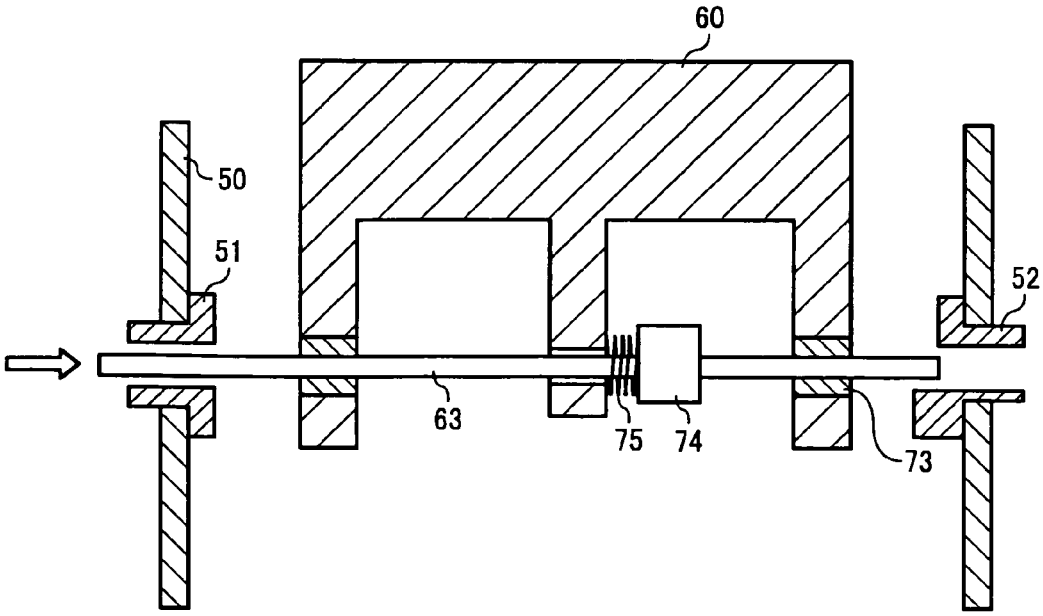
FIG. 9 is a schematic diagram for explaining an operation of mounting the through shaft shown in FIG. 7.
Figure 10:
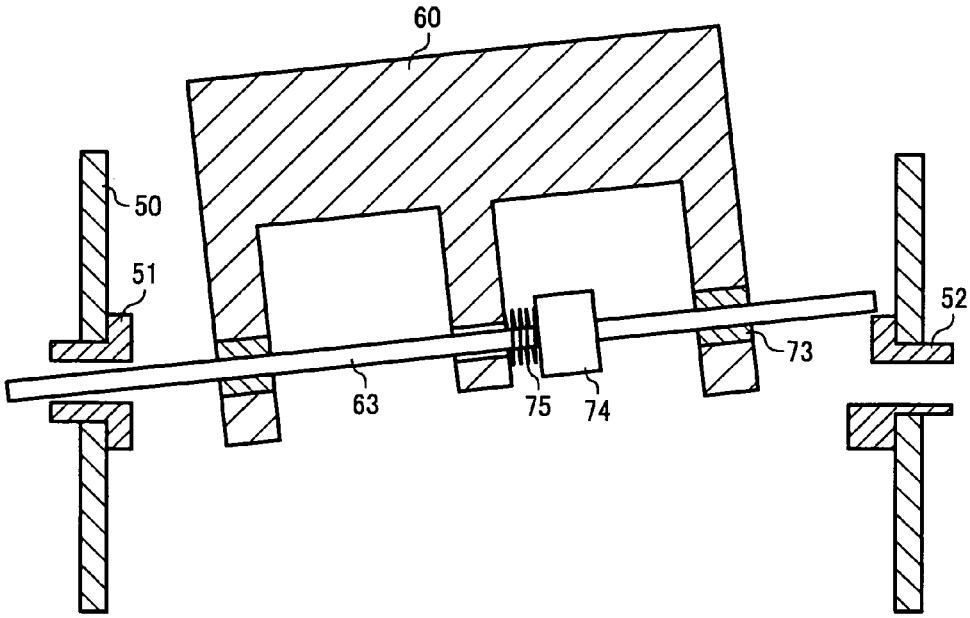
FIG. 10 is a schematic diagram for explaining another operation of mounting the through shaft when the sheet reversing unit is askew.

When the swing shaft 63 reaches a position at which the swing shaft 63 is aligned with the bearings 51 and 52 in a state the spring 75 is compressed by pushing the swing shaft 63 to the left as shown in FIG. 9, the swing shaft 63 is moved to the right by the action of the spring 75, and both ends of the swing shaft 63 are supported by the bearings 51 and 52. More specifically, as shown in FIG. 10, a left end 63L of the swing shaft 63 is first fitted into the bearing 51. At this time, the right end 63R is positioned higher than the left end 63L, so that the sheet reversing unit 60 is askew. In addition, the right end 63R hits a side wall of the body 50, and the spring 75 is compressed. When the sheet reversing unit 60 is moved to a horizontal position as shown in FIG. 9, the swing shaft 63 automatically moves to a position properly supported by the bearings 51 and 52 by the action of the compressed spring 75 as shown in FIG. 7. In this manner, the sheet reversing unit 60 can be easily mounted on the body 50.

Figure 11:
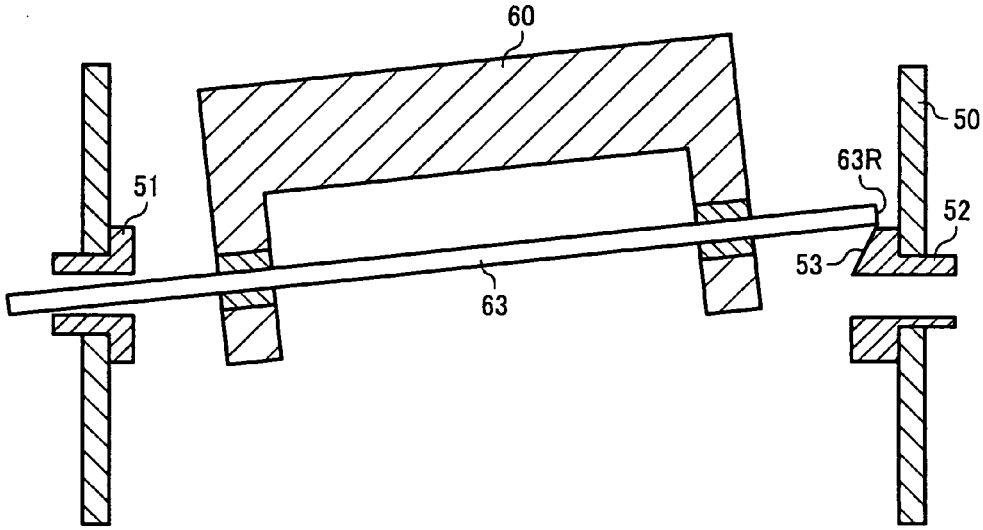
FIG. 11 is a schematic diagram of a through shaft of a sheet reversing unit according to a fourth embodiment of the present invention.
Figure 12:
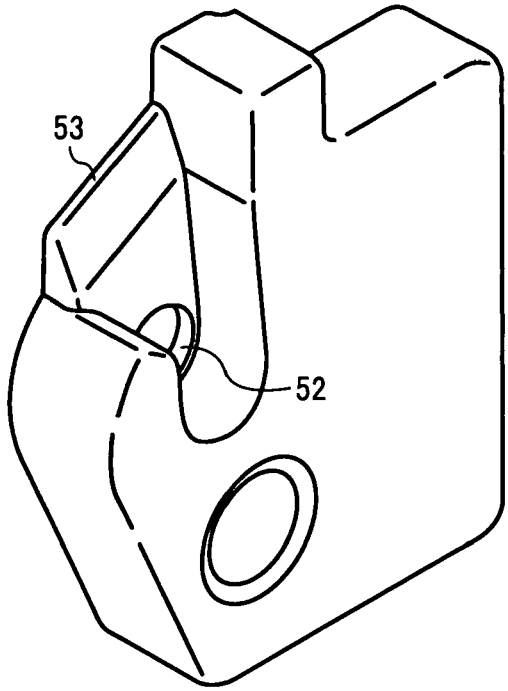
FIG. 12 is a perspective view of a bearing of the through shaft shown in FIG. 11.
Figure 13:
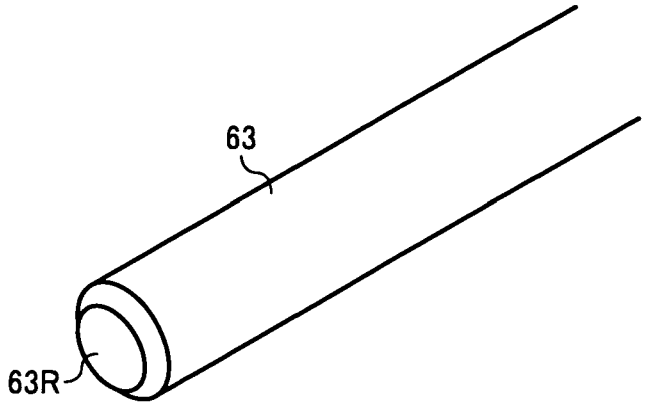
FIG. 13 is a perspective view of an end of the through shaft shown in FIG. 11.

According to a fourth embodiment of the present invention, for mounting the sheet reversing unit 60 on the body 50 more smoothly by dropping it downward, a slope surface 53 that is formed to slope to the left toward its bottom is formed on the upper portion of the bearing 52 as shown in FIGS. 11 and 12. At least the right end 63R is chamfered as shown in FIG. 13.

With this configuration, when the left end 63L is fitted into the bearing 51, the sheet reversing unit 60 moves to a proper position by its own weight, and the swing shaft 63 is properly supported by the bearings 51 and 52 by the action of the spring 75, thereby enabling the sheet reversing unit 60 to automatically be mounted.

Figure 14:
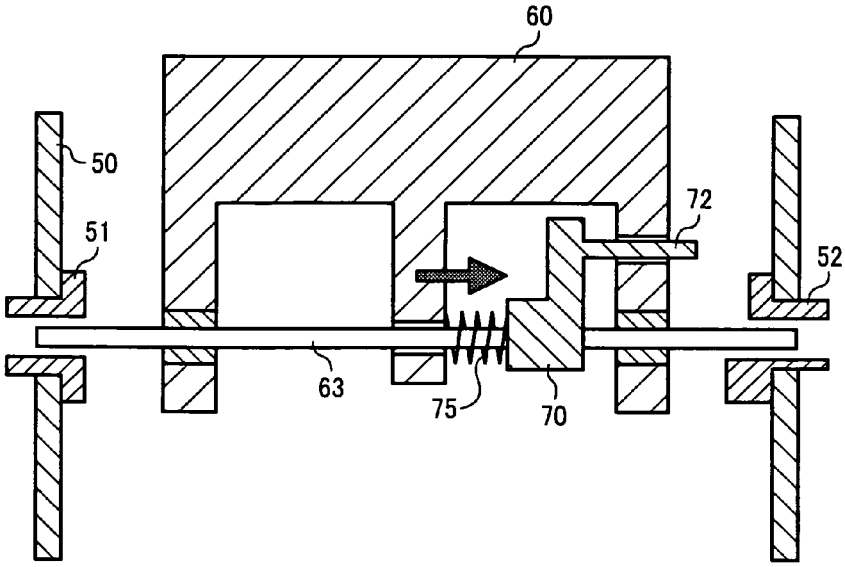
FIG. 14 is a schematic diagram of a through shaft of a sheet reversing unit according to a fifth embodiment of the present invention.
Figure 15:
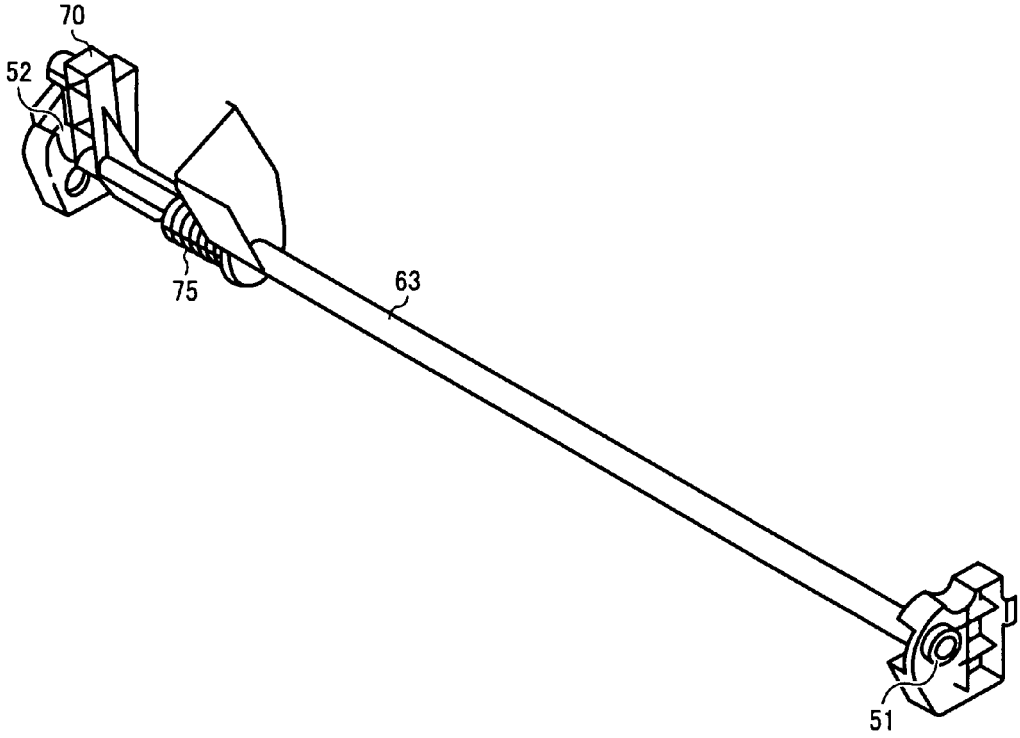
FIG. 15 is a perspective view of the through shaft shown in FIG. 14.
Figure 16:
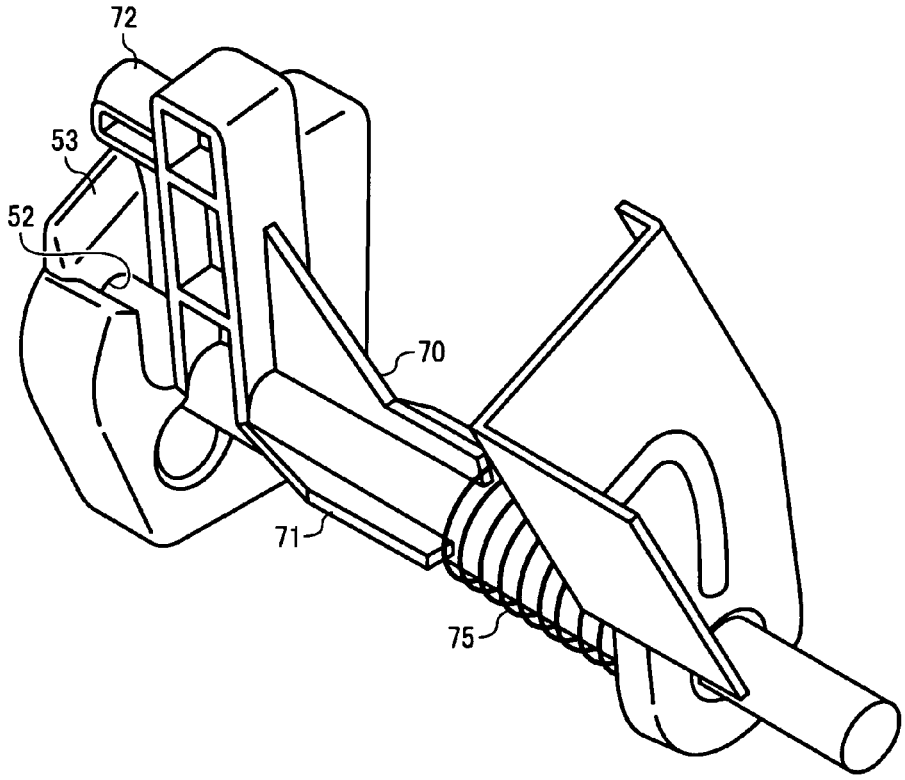
FIG. 16 is a perspective view of a relevant part of the through shaft shown in FIG. 14.

According to a fifth embodiment of the present invention, as shown FIGS. 14 to 16, the sliding lever 70 shown in FIG. 5 and the spring 75 shown in FIG. 7 are provided. The sliding lever 70 also works as the rigid body 74, so that the sliding lever 70 is formed of SECC steel plate.

With this configuration, for mounting the sheet reversing unit 60 on the body 50, when the left end 63L of the swing shaft 63 is fitted into the bearing 51, the sheet reversing unit 60 moves to a proper position by its own weight. Furthermore, the swing shaft 63 is properly supported by the bearings 51 and 52 by the action of the spring 75. In this manner, mounting of the sheet reversing unit 60 is completed.

For detaching the sheet reversing unit 60 from the body 50, the right end 63R is pulled out of the bearing 52 by pushing the lever unit 72 of the sliding lever 70 against the action of the spring 75 in a direction opposite to a direction indicated by an arrow in FIG. 14. Thus, the sheet reversing unit 60 can be taken out upward from the body 50.

As described above, exemplary embodiments of the present invention are explained. However, the present invention is not limited to the embodiments and can be modified in various manners. For example, the sheet reversing unit 60 is used as a supporting unit in the embodiments; however, it is possible to use an image carrier that can carry an image transferred to a sheet instead of a supporting unit.

According to an aspect of the present invention, it is possible to securely hold a shaft of a supporting unit because the supporting unit is supported by one through shaft and to position the supporting unit with high accuracy. Furthermore, it is possible to easily mount and detach even the supporting unit supported by the through shaft with respect to the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An apparatus to form an image on a recording medium, the apparatus comprising:

a supporting unit mounted on a body of the apparatus in a swingable manner around a swing fulcrum; and a through shaft that serves as the swing fulcrum, the through shaft being inserted into the supporting unit through the swing fulcrum so that both ends of the through shaft are supported by supporting members, wherein the through shaft includes an operation member that is fixed to the through shaft and slidable in an axial direction, and a biasing unit that biases a sliding force in one direction of the axial direction, when the supporting unit is opened with respect to the body, at least a part of a conveying path on which the recording medium is conveyed is exposed, and the operation member protrudes further outside the supporting unit in a state in which both ends of the through shaft are supported by the supporting members.

2. The apparatus according to claim ,1 wherein when a part of the operation member that protrudes further outside the supporting unit is pushed toward the supporting unit, the through shaft slides in a direction in which the part of the operation unit is pushed.

3. The apparatus according to claim 1, wherein a direction in which the through shaft slides by operating the operation member is opposite to a direction in which the biasing unit biases the sliding force.

4. The apparatus according to claim 1, wherein the biasing unit is a compression spring that is wound around the through shaft.

5. The apparatus according to claim 1, wherein the supporting members are bearings, and one of the bearings includes a guiding slope portion to guide the through shaft into an insert portion of the bearing.

6. The apparatus according to claim 5, wherein an end of the through shaft that is in contact with the guiding slope portion is chamfered.

7. The apparatus according to claim 1, wherein the recording medium includes a first side and a second side, and the supporting unit is a reversing unit to form an image on the second side of the recording medium with an image formed on the first side.

8. The apparatus according to claim 1, wherein the operation member is a sliding lever.

9. An apparatus to form an image on a recording medium, the apparatus comprising:

a supporting unit mounted on a body of the apparatus in a swingable manner around a swing fulcrum;

a through shaft that serves as the swing fulcrum, the through shaft at least partially inside the supporting unit, both ends of the through shaft supported by supporting members, the through shaft configured to be slidable in an axial direction;

a biasing member fixed to a surface of the through shaft; and a biasing unit configured to exert a force against the biasing member, wherein in an open position of the supporting unit, at least a part of a conveying path on which the recording medium is conveyed is exposed, a part of the biasing member protrudes outside the supporting unit, and the biasing member protrudes farther outside the supporting unit in a state in which both ends of the through shaft are supported by the supporting members than in a state when both ends are not supported by the supporting members.

10. The apparatus according to claim 9, wherein the biasing member is a sliding lever.

11. The apparatus according to claim 9, wherein the supporting members are bearings, and one of the bearings includes a guiding slope portion on an outside surface of the one of the bearings, the one of the bearings configured to guide the through shaft into an insert portion of the bearing.

12. An apparatus to form an image on a recording medium, the apparatus comprising:

a supporting unit mounted on a body of the apparatus in a swingable manner around a swing fulcrum;

a through shaft that serves as the swing fulcrum, the through shaft at least partially inside the supporting unit, both ends of the through shaft supported by supporting members, the through shaft configured to be axially slidable inside the supporting unit; and an operation member fixed to the through shaft, wherein in an open position of the supporting unit, at least a part of a conveying path on which the recording medium is conveyed is exposed, a part of the operation member protrudes outside the supporting unit, and the operation member protrudes farther outside the supporting unit in a state in which both ends of the through shaft are supported by the supporting members than in a state when both ends are not supported by the supporting members.

13. The apparatus according to claim 12, further comprising:

a biasing unit configured to exert a force on the operation member in an axial direction, wherein a direction in which the through shaft slides by operating the operation member is opposite to the axial direction in which the biasing unit exerts the sliding force.

14. The apparatus according to claim 12, wherein the biasing unit is a compression spring that is wound around the through shaft.

15. The apparatus according to claim 14, wherein the supporting members are bearings, and an outside surface of one of the bearings includes a guiding slope portion configured to guide the through shaft into an insert portion of the bearing.

16. The apparatus according to claim 15, wherein an end of the through shaft that is in contact with the guiding slope portion is chamfered.

* * * * *